United States Patent [19]

Deffner et al.

[11] 4,105,126

[45] Aug. 8, 1978

[54] STORAGE AND DISPENSING RACK

[75] Inventors: John F. Deffner, Lisle; Donald W. Wendel, Mt. Prospect; Russell M. Barnes, Bloomingdale, all of Ill.

[73] Assignee: Visual Marketing, Inc., Chicago, Ill.

[21] Appl. No.: 712,074

[22] Filed: Aug. 5, 1976

[51] Int. Cl.[2] ..... A47F 5/01

[52] U.S. Cl. ..... 211/49 D

[58] Field of Search ..... 211/49 D; 312/42

[56] References Cited

U.S. PATENT DOCUMENTS

| | | | |
|---|---|---|---|
| 2,888,145 | 5/1959 | Knott et al. | 211/49 D |
| 3,203,553 | 8/1965 | Pendergrast, Jr. et al. | 211/49 D |
| 3,306,688 | 2/1967 | Di Domenico | 312/42 |
| 3,393,808 | 7/1968 | Chirchill | 211/49 D |
| 3,499,539 | 3/1970 | Fisher | 211/49 D |

FOREIGN PATENT DOCUMENTS

| | | | |
|---|---|---|---|
| 1,456,468 | 9/1966 | France | 211/49 D |

*Primary Examiner*—Roy D. Frazier
*Assistant Examiner*—Terrell P. Lewis
*Attorney, Agent, or Firm*—Roy E. Hofer; Gary M. Ropski

[57] ABSTRACT

A rack for storing and dispensing cans is provided with means to simultaneously accommodate cans of different heights on each individual shelf. The shelves are inclined so that the cans will roll toward the front of the rack, and specially designed rails are positioned on opposite sides of the shelves to accommodate the differently sized cans.

4 Claims, 6 Drawing Figures

FIG. 1
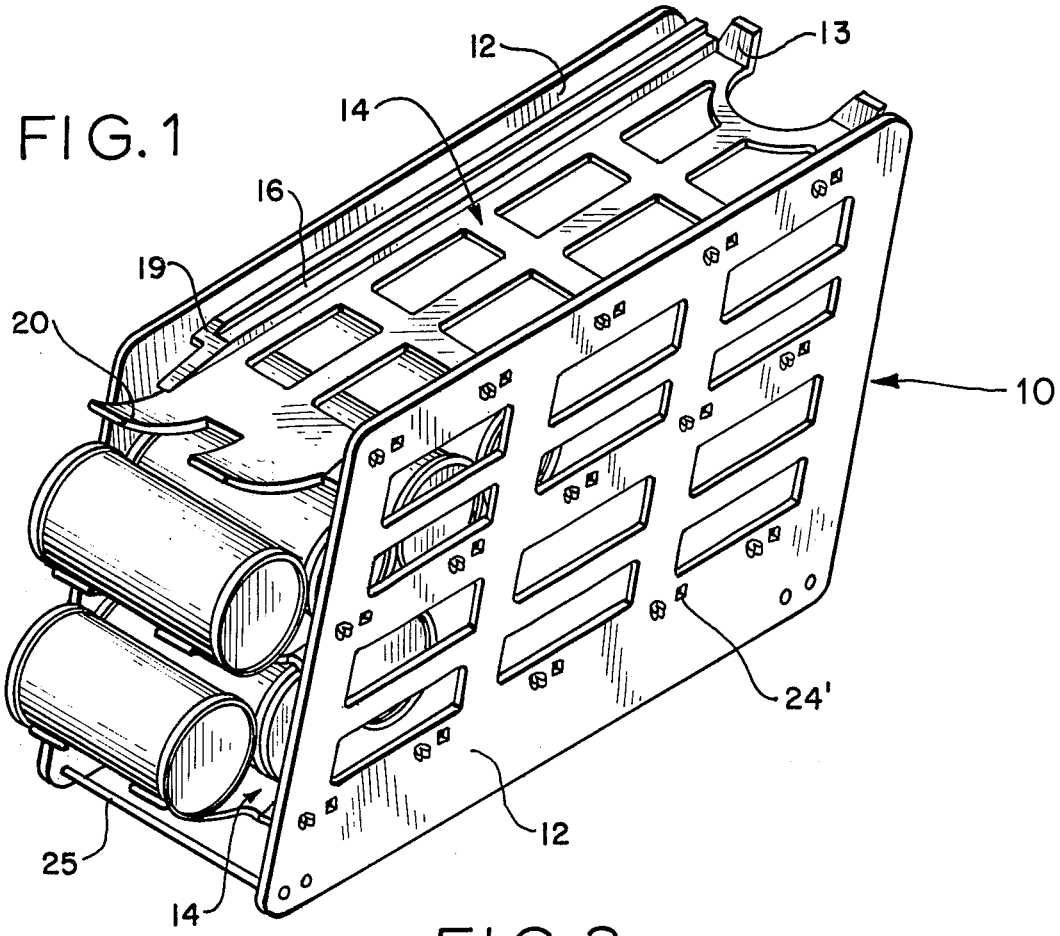
FIG. 3
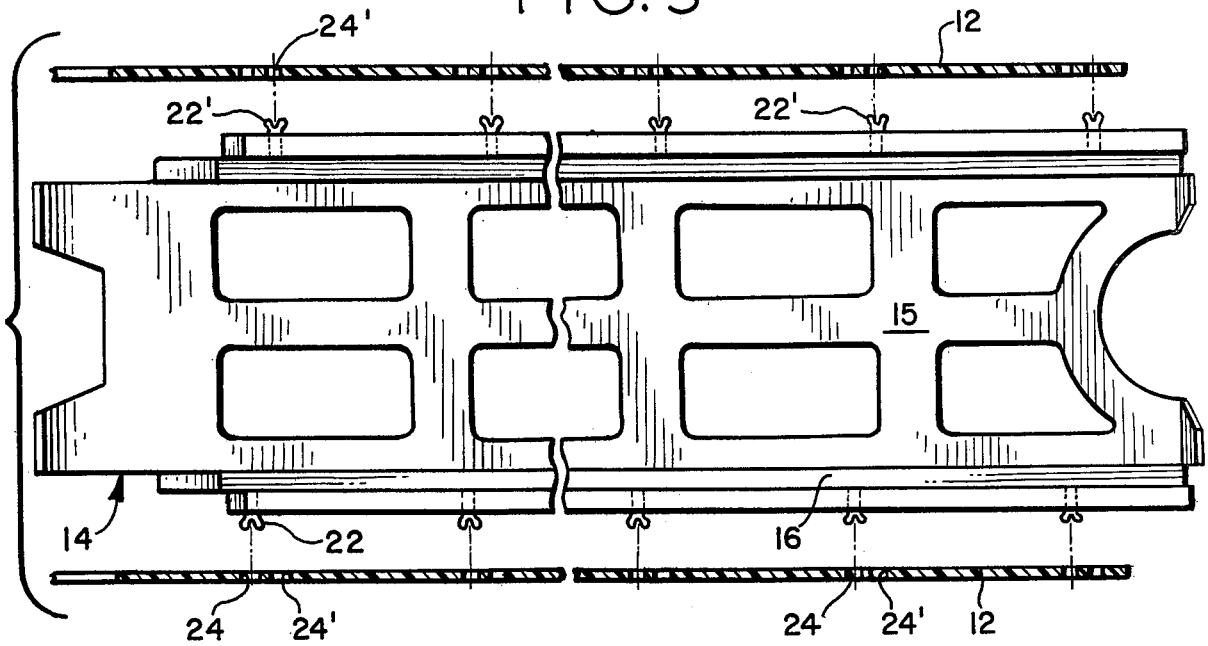
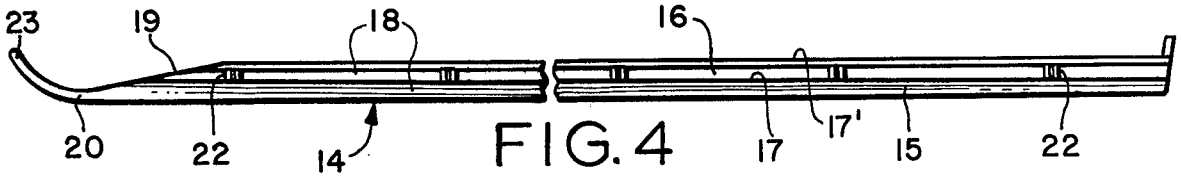
FIG. 4

STORAGE AND DISPENSING RACK

BACKGROUND AND SUMMARY OF THE INVENTION

This invention relates generally to storage and dispensing systems such as used, for example, in supermarkets and merchandising establishments. More particularly, the present invention is directed to an improved rack for storing and dispensing cans and other cylindrically shaped containers wherein a plurality of containers may be simultaneously stored and dispensed even though the containers may be of different heights.

Storage and dispensing racks for can goods and the like are well known in the art. Examples of typical prior art racks can be found in U.S. Pat. Nos. 3,805,964; 3,606,022 and 3,203,553. While storage and dispensing systems such as those disclosed in these United States patents have met with some commercial success, they nevertheless suffer from a number of disadvantages. For example, many prior art racks are assembled at the point of manufacture and therefore require greater amounts of space during storage and shipment. Other prior art systems include a great number of components which make assembly of the racks more difficult and time consuming. Still further, the known prior art racks used to dispense can goods suffer from the major disadvantage that the individual shelves will accommodate cans of only a single height. When cans having different heights are utilized in such a device jamming problems may arise due to the fact that the shorter cans do not move along the inclined shelf in a uniform fashion.

SUMMARY OF THE INVENTION

The present invention is directed to an improved storage and dispensing rack for cans and the like which overcomes the majority of problems associated with prior art racks. The rack is constructed from two separate components which may be easily assembled at the point of sale. This is accomplished through the use of a modular design wherein all of the rack shelves are identical and wherein all of the supporting side walls are also identical. Such a design, of course, also minimizes the costs of manufacture.

The invention is also directed to a storage and dispensing rack which includes means for simultaneously accommodating on a single shelf cans and other such containers having different heights. Moreover, the rack includes means for positively guiding the cans along the shelf to avoid jamming problems which typically arise when cans of different heights are used with prior art racks.

Accordingly, it is an object of the invention to provide a storage and dispensing rack which will display to maximum advantage cans and the like but which is also both easily and economically manufactured.

It is also an object of the invention to provide a storage and dispensing rack for cans which may be expeditiously assembled even by unskilled labor at the point of sale.

It is a further object of the invention to provide a storage and dispensing rack which includes means for simultaneously accomodating cans of different heights on each individual shelf.

Still a further object of the invention is to provide a storage and dispensing rack for cans and the like wherein each individual shelf includes means for positively guiding cans of different heights thereby substantially eliminating the jamming problems associated with prior art devices.

Another object of the invention is to provide a storage and dispensing rack for cans and the like wherein the cans can be placed on the individual shelves from either the front or the back of the rack.

BRIEF DESCRIPTION OF THE DRAWINGS

The novel features which are believed to be characteristic of the invention are set forth in the apended claims. The invention itself, however, together with further objects and attendant advantages thereof, will be best understood by reference to the following description taken in connection with the accompanying drawings in which:

FIG. 1 is a perspective view illustrating one preferred embodiment of the invention;

FIG. 3 is an exploded plan view of the embodiment of FIG. 1 with the side panels in cross-section;

FIG. 4 is a side elevation of a shelf constructed in accordance with one preferred embodiment of the invention;

DETAILED DESCRIPTION OF THE PREFERRED EMBODIMENTS

Figure 6:
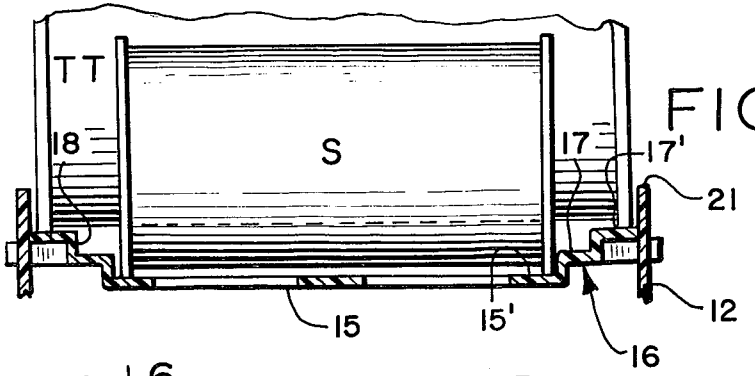
FIG. 6 is a view taken along line 6—6 of FIG. 2 showing the placement of a shorter can and the tallest can on the rack in accord with the present invention.

Reference is now made to the drawings and particularly to FIG. 1 wherein one presently preferred rack 10 includes a frame having a pair of generally upright panels 12 which support a plurality of inclined shelves 14. As will be described in greater detail below, the panels 12 and shelves 14 are the only components necessary in the assembly of the rack 10, and they may be used repetitively to form any number of multitiered storage and dispensing racks joined in side by side arrangement. The cans or other like containers can be placed on the inclined shelves 14 from either the front or the rear of the rack 10 and, as the first can is removed, the remaining cans will roll forward placing another can in the proper dispensing position. The cans are retained at the forward or lower end of each shelf by the retaining member 20.

In accordance with the present invention, the rack 10 is provided with means for simultaneously accommodating on each shelf 14 cans of different heights. More specifically, each shelf 14 includes means forming a first level which accommodates shorter cans and means forming a second or even a plurality of further levels, each higher level accommodating successively taller cans.

Figure 5:
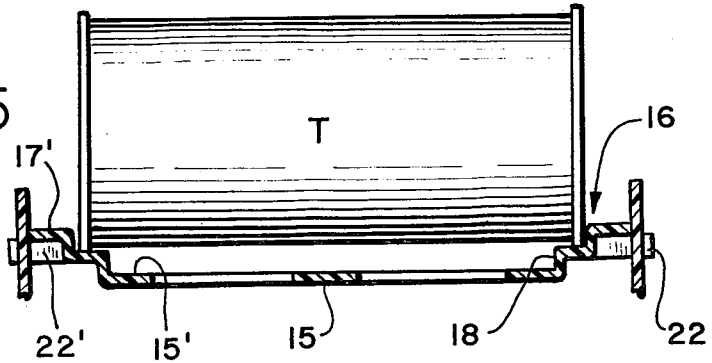
FIG. 5 is a view taken along line 5—5 of FIG. 2 showing the placement of a taller can on the shelf in accord with the present invention.
Figure 2:
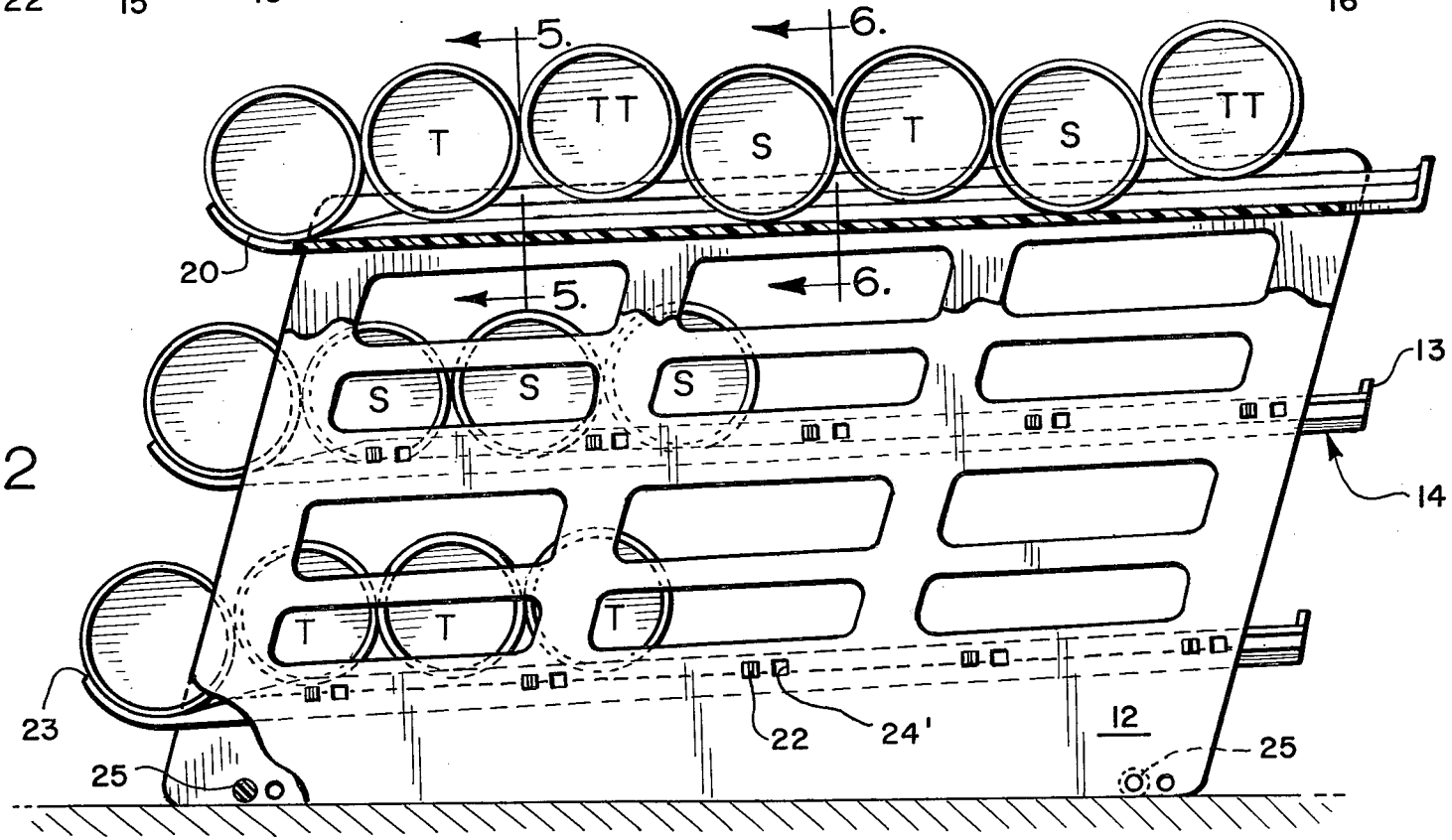
FIG. 2 is a side elevation clearly illustrating the disposition of cans having different heights on a single shelf of the rack.

In one preferred embodiment of the invention illustrated in FIGS. 5 and 6, the first level forming means comprises an inner base portion 15 having a support surface 15' and a transverse dimension slightly greater than the shorter cans S; and the means forming the further levels comprises longitudinally extending rails, designated generally as 16, which are dimensioned to accommodate taller cans T and the tallest cans TT. The rails 16 are positioned on opposite sides of the base portion 15 and preferably have an outwardly extending, stepped cross-sectional configuration.

It will be appreciated by those skilled in the art that the shelf 14, having inner base portion 15 and rails 16, performs the dual functions of providing both different can receiving levels and guide means which cooperate with the ends of the cans to assure their uniform and proper movement down the shelf to the forward dispensing position. Thus, each of the shelves 14 includes a plurality of horizontal support surfaces 15', 17 and 17' and a plurality of vertical guide surfaces 18. The guide surfaces 18 engage the ends of the containers S and/or T and positively guide them along the shelf 14 toward the forward end of the rack 10. It will be appreciated that the specific dimensions of the steps of rails 16 will vary depending upon the different heights of the various cans which are to be displayed and dispensed from the rack. In addition, in the preferred embodiment the rails 16 terminate with an upper most horizontal surface 17' which abuts the inside of panel 12 below the uppermost edge 21 thereof. In this manner, the panel 12 forms the guide means for the tallest can, i.e., a third size of cans, accommodated by a single shelf 14, as shown in FIG. 6.

The shelves 14 are also preferably provided with a rear stop element 13 which projects upwardly from the base portion 15. The stop element 13 will prevent cans from falling from the rear of the rack when it is being loaded from the front.

As can be clearly seen in FIGS. 1 and 4, the stepped cross-sectional configuration of the rails 16 changes at 19 near the forward end of the rack. Specifically, the vertical dimension of the vertical guide surfaces 18 diminish such that, as the individual cans reach the dispensing position in the forward end of the rack 10, the rail 16 has completely terminated. In this manner each can, regardless of its dimension, is held by the retaining member 20 and is easily accessible to the consumer. Alternatively, the anterior lip 23 of retaining member 20 may have a vertical dimension sufficient to retain even those cans which would ride on the uppermost horizontal support surface 17' of rails 16. Under such circumstances the rails 16 may retain their stepped, cross-sectional configuration throughout their entire length.

The rails 16 may be positioned at the lateral edges of each shelf 14 and are preferably formed as an integral part of the shelf 14. In addition, each rail 16 is provided with a plurality of snap studs 22 which engage the apertures 24 in side panels 12 in the assembly of the rack. It should be noted that the left rail of each shelf 14 has the snap studs 22 slightly displaced from the snap studs 22' associated with the right rail. Similarly, the side panels 12 have a series of apertures 24' which are slightly displaced from apertures 24. As will be appreciated by those skilled in the art, this arrangement allows a single panel 12 to support shelves on both sides thereof and, accordingly, a plurality of multitiered dispensing racks may be joined in integral, side by side relationship still using only the two component parts described above.

The rack 10 may also include at least two transverse members 25 which are positioned below the lowermost shelf 14. The members 25 are secured to each side panel 12 in any suitable manner and function as support bars where the rack is placed on a grating in such a way that the side panels would slide through the spaces in the grating.

The side panel and shelf components may be easily manufactured from plastic by various molding and/or stamping techniques. Of course, other materials such as metals, reinforced paperboard or cardboard may also be employed in the construction of the rack 10.

It should be understood that various changes and modifications to the preferred embodiments described herein will be apparent to those skilled in the art. For example, the rails 16 may be replaced by a series of paired, elongated ribs which would extend upwardly from the base of shelf 14. Each pair of ribs would have a height greater than the pair disposed to the inside thereof. Thus, each pair of ribs would function, as do the rails 16, to provide both a raised level for taller cans and guide means for the cans held at the next lower level. Such changes and modifications can be made without departing from the spirit and scope of the present invention and without diminishing its attendant advantages. It is, therefore, intended that such changes and modifications be covered by the following claims.

We claim:

1. A rack for storing and dispensing individual containers having a substantially cylindrical side wall and ends substantially perpendicular to the axis of said side wall, said rack comprising:

at least one elongated shelf;

means for supporting said shelf on an incline to allow said containers to roll from one end of said shelf to the other end thereof;

means forming a first level of said shelf for accommodating first containers, said first level forming means comprising an inner base portion of said shelf; and means forming at least one further level, each successively higher level accommodating containers successively taller than said first containers, said further level forming means comprising a pair of longitudinally extending rails positioned on opposite sides of said base portion, wherein each said rail has an outwardly extending stepped cross-sectional configuration, the horizontal portions of said rails forming said further levels of said shelf and the vertical portions of said rails forming means to guide said containers along said shelf, and further, wherein the uppermost horizontal portions of said rails are positioned below the uppermost edge of said shelf supporting means whereby said shelf supporting means cooperates with the ends of the tallest containers accommodated by said shelf to positively guide said tallest containers along the full length of said shelf.

2. A rack for storing and dispensing individual containers having a substantially cylindrical side wall and ends substantially perpendicular to the axis of said side wall, said rack comprising:

at least one elongated shelf;

means for supporting said shelf on an incline to allow said containers to roll from one end of the shelf to the other end thereof, said shelf supporting means comprising at least two identical panels, each having means for accommodating at least one shelf on both sides simultaneously; and means on said shelf cooperating with said container ends to guide said containers along said shelf, said guide means including a pair of elongated rails, each of said rails having a stepped cross-sectional configuration with guide surfaces which cooperate with said container ends whereby said guide means is adapted to simultaneously accommodate containers of different heights, and wherein the vertical dimension of said guide surfaces of each said rail gradually diminishes beginning at a point near said other end of said shelf such that each said rail terminates adjacent said other end.

3. The storing and dispensing rack of claim 2 wherein said shelf also includes means for retaining said containers at said other end.

4. A rack for storing and dispensing a plurality of containers having a substantially cylindrical side wall and ends substantially perpendicular to the axis of said side wall, said rack comprising:

a plurality of identically configured elongated shelves;

a plurality of identically configured vertically disposed panels; and means for simultaneously and removably engaging said shelves on opposite sides of each said panel, wherein said engaging means is adapted to allow said shelves to be mounted on opposite sides of each said panel at common levels, and wherein said engaging means includes a plurality of paired apertures disposed in said panels and a plurality of studs integral with the sides of said shelves, the studs on one side of said shelves positioned to align with one of said paired apertures and the studs on the other side of said shelves positioned to align with the other of said paired apertures.

* * * * *